US006792232B2

(12) United States Patent
Suzuki et al.

(10) Patent No.: US 6,792,232 B2
(45) Date of Patent: Sep. 14, 2004

(54) CHARGING APPARATUS AND IMAGE FORMING APPARATUS

(75) Inventors: Hiroyuki Suzuki, Kanagawa (JP); Ryo Inoue, Ibaraki (JP); Ryo Nakamura, Shizuoka (JP)

(73) Assignee: Canon Kabushiki Kaisha, Tokyo (JP)

( * ) Notice: Subject to any disclaimer, the term of this patent is extended or adjusted under 35 U.S.C. 154(b) by 0 days.

(21) Appl. No.: 10/370,773

(22) Filed: Feb. 24, 2003

(65) Prior Publication Data

US 2003/0185593 A1 Oct. 2, 2003

(30) Foreign Application Priority Data

Feb. 26, 2002 (JP) ..... 2002-050373
Feb. 20, 2003 (JP) ..... 2003-043146

(51) Int. Cl.[7] ..... G03G 15/02
(52) U.S. Cl. ..... 399/175
(58) Field of Search ..... 399/50, 168, 169, 399/174, 175, 176

(56) References Cited

U.S. PATENT DOCUMENTS 6,301,459 B1 10/2001 Ishiyama et al. ..... 399/175

FOREIGN PATENT DOCUMENTS

JP 9-222773 8/1997
JP 2001-109347 4/2001

*Primary Examiner*—Hoang Ngo
(74) *Attorney, Agent, or Firm*—Fitzpatrick, Cella, Harper & Scinto

(57) ABSTRACT

To provide a charging apparatus including: a first charging unit for charging a body to be charged, the first charging unit including a magnetic brush that contacts the body to be charged; and a second charging unit that is provided on a downstream side of the first charging unit with respect to a moving direction of the body to be charged, the second charging unit including a magnetic brush that contacts the body to be charged, in which a contact width, with which the magnetic brush of the first charging unit contacts the body to be charged, is wider than a contact width with which the magnetic brush of the second charging unit contacts the body to be charged.

16 Claims, 7 Drawing Sheets

CHARGING APPARATUS AND IMAGE FORMING APPARATUS

BACKGROUND OF THE INVENTION

1. Field of the Invention

The present invention relates to a charging apparatus provided with a magnetic brush that contacts a body to be charged, with this charging apparatus being suitably applied, in particular, to an image forming apparatus that develops an electrostatic latent image formed on an image bearing member, such as a photosensitive member or a dielectric member, using developer and records the developed latent image on a sheet or the like.

2. Related Background Art

FIG. 8 is a front view showing a construction of a conventional image forming apparatus.

The image forming apparatus shown in FIG. 8 is constructed by a photosensitive drum 1, LED exposing means 2, a corona charger 3, a developing device 4, a cleaner 5, a fixing device 6, a transferring apparatus 7, pre-exposing means 8, a scanner unit 9, an original table 10, a transferring material supplying mechanism 11, a transferring material cassette 12, a main body 13, a discharging roller 14, and a sheet tray 15. The transferring apparatus 7 is constructed by a transferring belt 71, a drive roller 72, a driven roller 73, and a transferring apparatus 74. Also, the unit 9 is constructed by an original illuminating lamp, a short-focus lens array, and a CCD sensor.

When a copy start button is depressed and a copy start signal is inputted into a control portion (not shown), the photosensitive drum 1 starts to rotate and its surface is charged by the corona charger 3 to have a predetermined potential during the rotation. On the other hand, the scanner unit 9 starts to move and emits illuminating and scanning light toward an original G placed on the original table 10. During this operation, reflection light generated by reflection of the illuminating and scanning light by a surface of the original is imaged by the short-focus lens array and is made incident on the COD sensor (including a light receiving portion, a transferring portion, and an outputting portion) A light signal is converted into a charge signal in the light receiving portion of the COD sensor. Then, in the transferring portion, the charge signals are successively transferred to the outputting portion in synchronization with a clock pulse. In this outputting portion, the charge signal is converted into a voltage signal, which is then subjected to amplification and reduction in impedance and is outputted. The obtained analog signal is converted into a digital signal through known image processing and is sent to a printer portion constructed by components of the photosensitive drum 1 to the pre-exposing means 8 incorporated in the main body 13.

In this printer portion, the LED exposing means 2 is turned ON/OFF for light emission in accordance with an image signal received from an original table side, thereby forming an electrostatic latent image corresponding to an original image on the surface of the photosensitive drum 1. Then, the electrostatic latent image on the photosensitive drum 1 is developed by the developing device 4 in which toner particles are contained, thereby forming a toner image on the photosensitive drum 1.

The toner image formed on the photosensitive drum 1 in this manner moves onto the transferring apparatus 7 in accordance with the rotation of the photosensitive drum 1 and is electrostatically transferred onto a transferring material by the transferring apparatus 74. Following this, the transferring material (not shown) is electrostatically separated, is conveyed by the transferring belt 71, and is fed into the fixing device 6. In this fixing device 6, the transferring material that has been fed thereinto is subjected to heat-fixing, thereby heat-fixing and outputting an image.

On the other hand, the surface of the photosensitive drum 1, from which the toner image has been transferred, is subjected to processing where adhering contaminant, such as transfer residual toner, is removed by the cleaner 5. Further, as occasion arises, there is performed exposure by the pre-exposing means 8 for removing a light memory resulting from the image exposure. Following this, the photosensitive drum 1 is applied to the next image formation.

As a material for the photosensitive drum 1, in many cases, there is used an organic photosensitive member, an amorphous silicon-based photosensitive member (hereinafter referred to as the "a-Si-based photosensitive member"), or the like. The a-Si-based photosensitive member has various features. For instance, the a-Si-based photosensitive member is high in surface hardness, exhibits a high sensitivity to a semiconductor laser or the like, and shows almost no degradation even after repetitive usage. Therefore, the a-Si-based photosensitive member is used as a photosensitive member of a high-speed copier, a laser beam printer, or the like.

As a method of charging the a-Si-based photosensitive member, it is possible to use a corona charging system using corona discharging, a roller charging system with which charging is performed through direct discharging using a conductive roller, an injection charging system with which charging is performed by maintaining a sufficient contact area using magnetic particles or the like and directly injecting charges into the surface of a photosensitive member, or the like.

Among these systems, the corona charging system and the roller charging system utilize discharging, so that discharge products tend to adhere to a surface. Also, the a-Si-based photosensitive member has an extremely high surface hardness and is resistant to abrasion, so that discharge products tend to remain on its surface. In addition, a smeared image phenomenon easily occurs when charges move in a surface direction on the photosensitive member surface, on which an electrostatic latent image has been formed, due to the absorption of moisture or the like under high-humidity circumstances or the like. In contrast to this, the injection charging system does not positively use discharging and is a charging system with which charges are directly injected from a portion contacting the photosensitive member surface. Therefore, there hardly occurs the smeared image phenomenon.

In the conventional image forming apparatus, however, the a-Si-based photosensitive member is obtained using a production method with which a gas is plasmanized and solidified using a high-frequency wave or a micro wave and a film is formed by depositing the plasmanized and solidified gas on an aluminum cylinder. Consequently, in the case where the plasma is not caused in a uniform manner, unevenness of film thickness or unevenness of composition occurs in a circumferential direction or a longitudinal direction. Therefore, conventionally, potential unevenness of around several tens of V has occurred in the developing portion. This is caused by a phenomenon where a difference in electrostatic, capacity occurs due to the unevenness of film thickness and therefore there occurs a difference in charging performance as well as a phenomenon where potential decay under a dark state (hereinafter referred to as the "dark decay") between charging and developing due to pre-exposure performed to erase a light memory resulting from previous rotation varies due to a difference in the film thickness or composition and therefore, the potential unevenness is further increased in the developing portion.

In the case where the a-Si-based photosensitive member is used, the dark decay described above becomes extremely large in comparison with a case of an organic photosensitive member even under a dark state, and the potential decay due to the light memory resulting from image exposure is further increased, so that it is required to provide the pre-exposing means 8 before charging in order to erase the light memory resulting from previous rotation. Therefore, the dark decay between charging and developing becomes extremely large and there occurs a potential decay of around 100 to 200 V. At this time, due to the film thickness unevenness or composition unevenness described above, there occurs a potential unevenness of around several tens of V.

If this potential unevenness occurs, the a-Si-based photosensitive member having a large electrostatic capacity is significantly influenced by the unevenness because of its small contrast in comparison with the organic photosensitive member, which leads to a situation where density unevenness becomes prominent.

In view of such a problem, it is effective to use a method with which charging is performed for a plurality of times, for instance. If charging is performed for a plurality of times in order to solve the problem in that the dark decay is increased due to the light memory, it becomes possible to substantially reduce the light memory through charging performed for the first time, which makes it possible to reduce the dark decay after charging is performed for the second time. As a result, a potential ghost or potential unevenness is substantially improved.

Here, if the injection charging system is used when charging is performed for a plurality of times, the potential ghost and the potential unevenness are substantially improved because of its high charging ability and high potential converging property. Also, discharging is hardly used in the case of the injection charging system as described above, so that there hardly occurs the smeared image phenomenon. As an injection charger, it is effective to use a magnetic brush charger that uses magnetic particles, for instance. The magnetic brush charger performs charging using contact points of the magnetic particles, so that there are obtained advantages in that the surface area for charging becomes wide and resistance to pollution is obtained. As a result, it becomes possible to maintain high charging performance even for a long-term use.

In the case where the magnetic brush charger is used, however, there is a problem in that the magnetic particles adhere to the photosensitive member. This is a phenomenon where upon charging, in the case where a large potential difference occurs between a photosensitive member surface and a magnetic particle holding member to which a voltage is applied, the magnetic particles adhere to the photosensitive member and mix into a developing apparatus from the photosensitive member. In particular, this phenomenon easily occurs in end portions of a magnetic particle coating. This is because a portion that can be in contact with the magnetic particles and be charged and a portion that is not capable of contacting the magnetic particles and is not charged coexist in the end portions, so that a large potential difference is partially caused and the adhesion of the magnetic particles to the photosensitive member becomes prominent. On the other hand, there is also used a method with which insulation processing is performed in the end portions of the magnetic particle coating and the potential gradient of the coating end portions is reduced, thereby suppressing the magnetic particle adhesion phenomenon. In this case, however, the magnetic particle coating portions are subjected to the insulation processing, so that there may occur various problems. For instance, a negative effect develops due to a difference in coating amount resulting from a difference in surface property between the magnetic particle holding member and the portions subjected to the insulation processing. Also, the durability of the portions subjected to the insulation processing is decreased due to rubbing with the magnetic particles. Further, although it is possible to suppress the magnetic particle adhesion phenomenon, it is difficult to completely avoid this phenomenon.

SUMMARY OF THE INVENTION

An object of the present invention is to provide a charging apparatus and an image forming apparatus with which a body to be charged is charged using a plurality of chargers.

Another object of the present invention is to provide a charging apparatus and an image forming apparatus that prevent a situation where magnetic particles constituting a magnetic brush of a charger adhere to a body to be charged.

Another object of the present invention is to provide a charging apparatus and an image forming apparatus with which even it magnetic particles adhere to a body to be charged, it is possible to recover the magnetic particles by means of an action of magnetic field generating means of a charger.

Another object of the present invention is to provide a charging apparatus and an image forming apparatus with which in the case where a body to be charged is charged using a plurality of magnetic brush chargers, there is solved a problem caused by adhesion of magnetic particles of the magnetic brushes to the body to be charged.

Another object of the present invention is to provide a charging apparatus and an image forming apparatus with which each area of a body to be charged corresponding to one of end portions of a magnetic brush of a magnetic brush charger is charged in advance.

Another object of the present invention is to provide a charging apparatus and an image forming apparatus with which it is possible to recover magnetic particles adhering to each area of a body to be charged corresponding to one of end portions of a magnetic brush of a magnetic brush charger by means of an action of magnetic field generating means.

Another object of the present invention is to provide an image forming apparatus that is suited for a case where amorphous silicon is used as a body to be charged.

Other objects and features of the present invention will become more apparent from the following detailed description to be made with reference to the accompanying drawings.

DESCRIPTION OF THE PREFERRED EMBODIMENTS

First Embodiment

Figure 1:
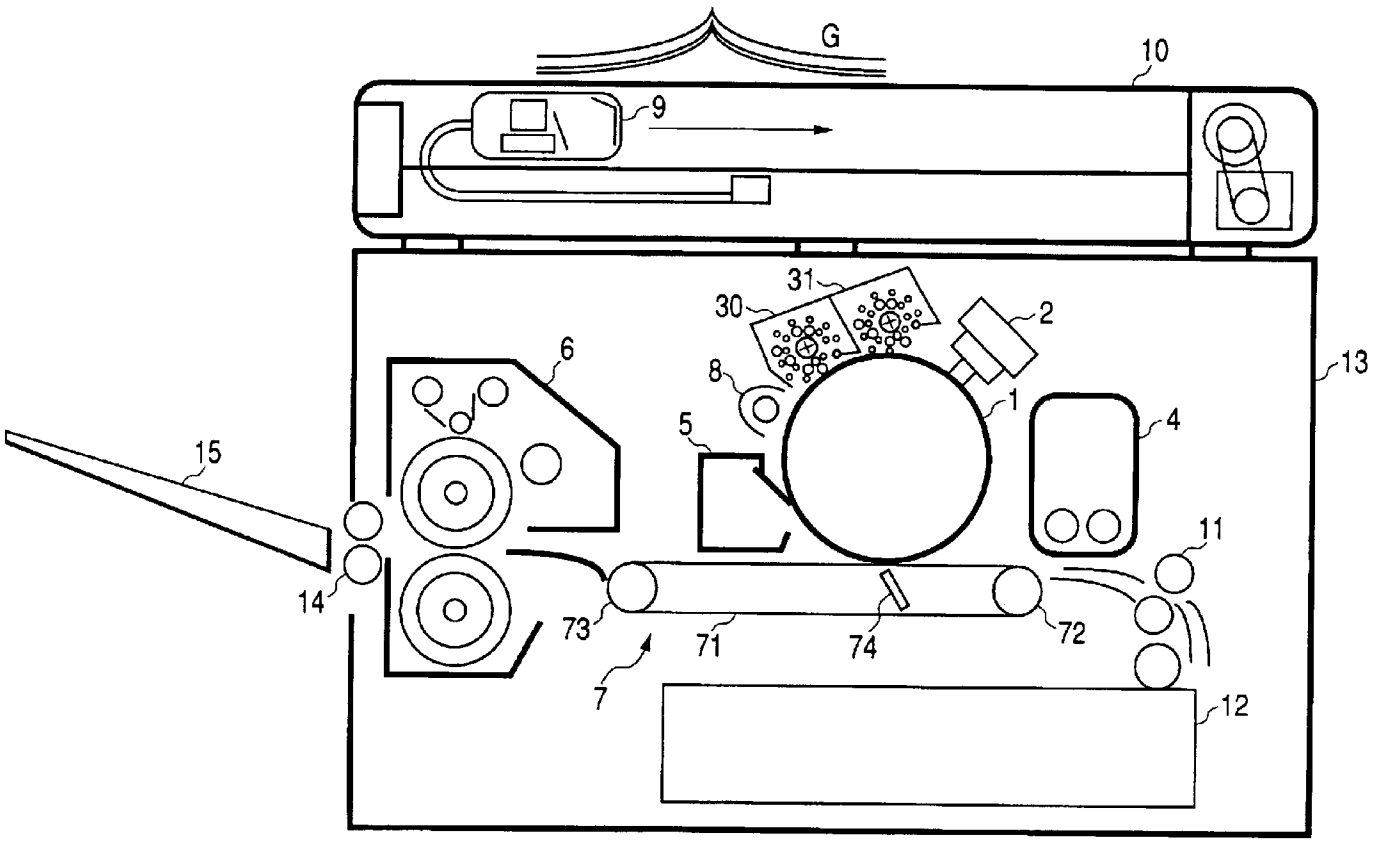
FIG. 1 is a front view showing an image forming apparatus in accordance with a first embodiment of the present invention.
Figure 8:
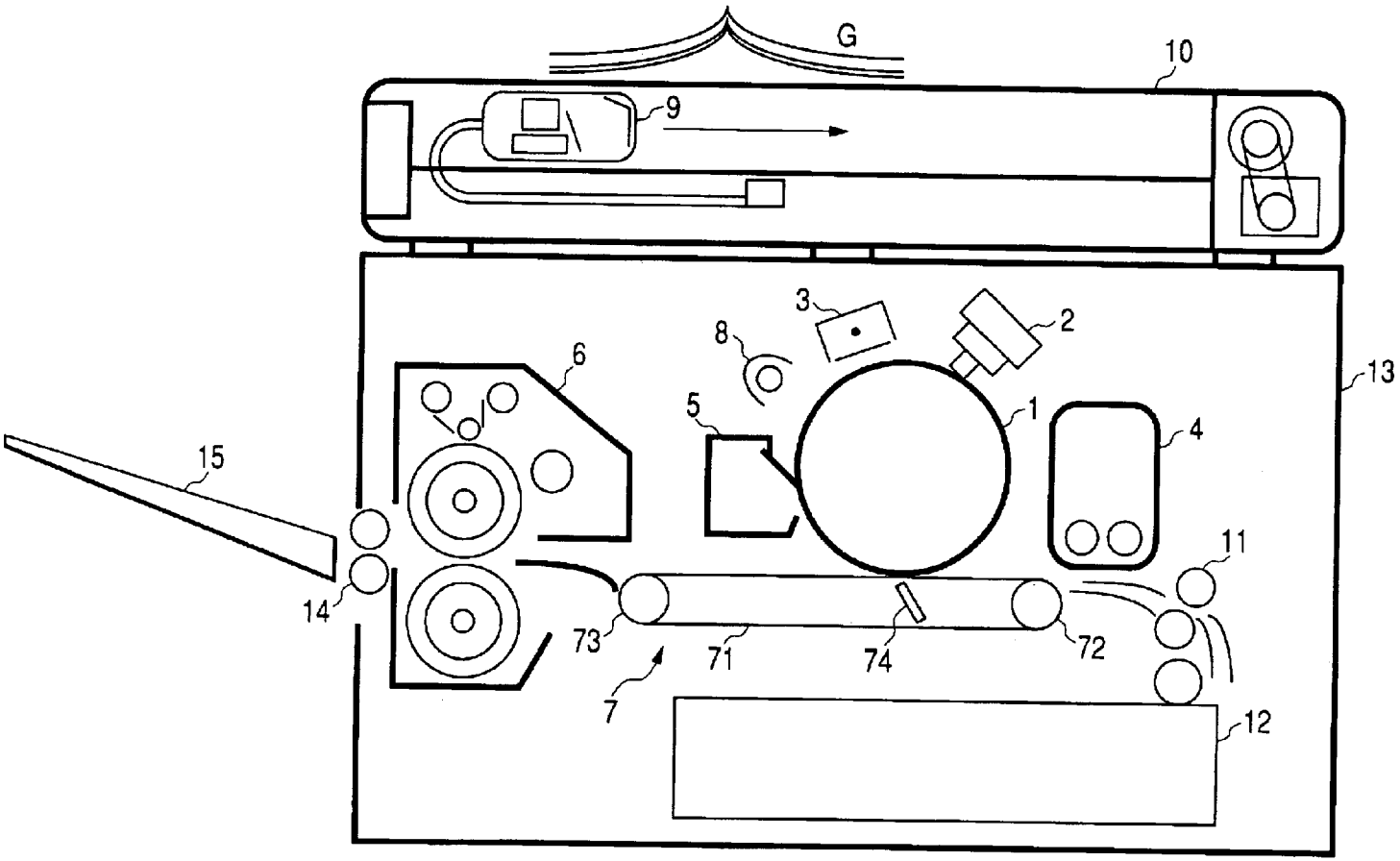
FIG. 8 is a front view showing a construction of a conventional image forming apparatus.

FIG. 1 is a front view showing an image forming apparatus in accordance with a first embodiment of the present invention. In FIG. 1, the same construction elements as those in FIG. 8 are given the same reference numerals and overlapping description will be omitted in the following description. In FIG. 1, there is obtained a construction where magnetic brush chargers 30 and 31 are used instead of the corona charger 3 in FIG. 8. These magnetic brush chargers are arranged in a serial manner with respect to the rotation direction of the photosensitive member and charging is performed twice. With these magnetic brush chargers 30 and 31, an amorphous silicon photosensitive member that is a body to be charged having a positive charging polarity is charged.

Figure 2:
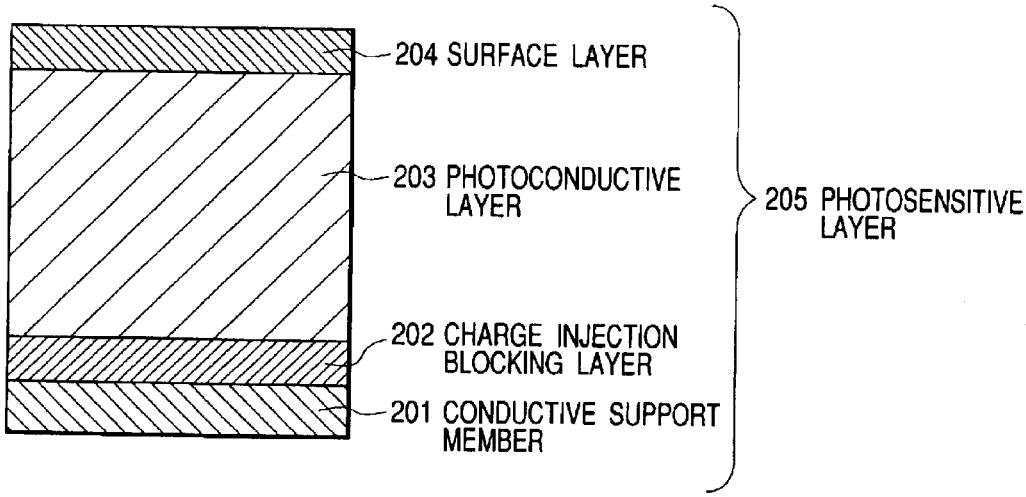
FIG. 2 is a schematic cross-sectional view showing a construction of an a-Si-based photosensitive member having a positive charging property.

FIG. 2 is a schematic cross-sectional view showing the construction of an a-Si-based photosensitive member having the positive charging property. The a-Si-based photosensitive member shown in FIG. 2 is constructed by a conductive support member 201 made of Al or the like, a photosensitive layer 205 (including a charge injection blocking layer 202 and a photoconductive layer 203 exhibiting photoconductivity), and a surface layer 204, with the charge injection blocking layer 202, the photoconductive layer 203, and the surface layer 204 being successively disposed on the surface of the conductive support member 201. Here, the charge injection blocking layer 202 is a layer for blocking the injection of charges from the conductive support member 201 into the photoconductive layer 203 and is provided as necessary. Also, the photoconductive layer 203 is constructed by an amorphous material that at least includes silicon atoms, and exhibits photoconductivity. Further, the surface layer 204 contains silicon atoms and carbon atoms (further contains either hydrogen atoms or halogen atoms or both of them as necessary), and has an ability to bear a latent image in an electrophotographic apparatus.

The a-Si-based photosensitive member is formed with a production method with which a gas is plasmanized and solidified using a high-frequency wave or a micro wave and the plasmanized and solidified gas is deposited on an aluminum cylinder to form a film. Therefore, if plasma is not caused in a uniform manner, this results in unevenness of film thickness or unevenness of composition. As a result of such unevenness, heretofore, potential unevenness of around several tens of V has occurred in a developing portion. This is caused by a phenomenon where a difference in electrostatic capacity occurs due to the unevenness of film thickness and therefore there occurs a difference in charging ability as well as a phenomenon where potential decay between charging and developing due to pre-exposure performed to erase a light memory resulting from previous rotation varies due to the film thickness unevenness and composition unevenness and therefore there is further increased the potential unevenness in the developing portion.

Next, there will be described a light memory. When the a-Si-based photosensitive member is charged and image exposure is performed, light carriers are generated and a potential is decayed. However, the a-Si-based photosensitive member has many dangling bonds (unbonded arms) and some of the light carriers are captured by the dangling bonds functioning as localized levels, so that the movability thereof is reduced or the recombination probability of the optically generated carriers is lowered. Accordingly, during an image forming process, some of the light carriers generated by exposure are released from the localized levels concurrently with the application of an electric field to the a-Si-based photosensitive member at the time of charging in the next process. As a result, a difference in surface potential of the a-Si-based photosensitive member occurs between exposed portions and non-exposed portions and this difference finally becomes a light memory.

In view of this problem, generally, exposure is uniformly performed in a pre-exposing process by the pre-exposing means 8, by which the light carriers that are latent in the a-Si-based photosensitive member are increased to an excessive level and there is obtained a situation where the light carriers are uniformly distributed on an entire surface. In this manner, the light memory is erased. At this time, by increasing the quantity of pre-exposing light emitted from the pre-exposing means 8 and by having the wavelength of the pre-exposing light approach the spectral sensitivity peak (around 680 to 700 nm) of the a-Si-based photosensitive member, it becomes possible to erase the light memory (ghost) in a more efficient manner.

However, if the film thickness of the a-Si-based photosensitive member is uneven, for instance, an electric field applied between photoconductive layers becomes uneven, so that there occurs a difference in releasing of the light carriers from the localized levels and the potential decay becomes large in accordance with a reduction in film thickness. Therefore, even if it is possible to perform uniform charging by the charging portion, potential unevenness occurs in the developing portion. Also, as to the charging ability, the electrostatic capacity becomes large in accordance with a reduction in film thickness and this situation is disadvantageous. If the charging ability is lowered, charging unevenness in the developing portion described above becomes more prominent, and this potential unevenness remains even after image exposure is performed. Also, when a developing process is performed, the potential unevenness appears as density unevenness that is prominent in a low-density area in which it is in particular easy to visually recognize the density unevenness.

Also, in the case of the a-Si-based photosensitive member, even in the case where its film thickness is constant, there tends to occur composition unevenness in a circumferential direction or a longitudinal direction due to its production method. Therefore, in many cases, a difference in generation amount of light carriers occurs within the surface and potential unevenness occurs due to a situation where dark decay does not become constant in a surface direction.

As a method of suppressing such dark decay and potential unevenness resulting from the light carriers, there is a method with which charging is performed for a plurality of times. By substantially reducing the light carriers through charging performed for the first time, it becomes possible to substantially suppress dark decay after charging performed for the second time. As a result, it becomes possible to substantially improve the potential unevenness and potential ghost.

As a member for charging the a-Si-based photosensitive member, an apparatus using corona charging has conventionally been put to practical use. However, the relative dielectric constant of a-Si is in a range of from 11 to 12 and is large in comparison with that of an organic photosensitive member, so that the electrostatic capacity becomes large and this increases a possibility that the charging ability is lowered and a smeared image or the like occurs due to a smeared latent image resulting from discharging.

In view of this problem, if a conductive roller, a fur brush roller, a magnet roller that holds magnetic particles, or the like is used as the charging member and the a-Si-based photosensitive member is charged under a condition where a sufficient contact state is maintained with respect to the photosensitive member that uses a contact charging member, because the surface of the a-Si-based photosensitive member is formed from a layer made of a material of $10^9$ to $10^{14}$ Ω·cm, it becomes possible to obtain a charging potential that is approximately equal to the direct current component in a bias applied to the contact charging member on the surface of the image bearing member. This charging method will be hereinafter referred to as the "injection charging" because charging is performed by directly injecting charges into the photosensitive member without using discharging. If this injection charging is used, there is not utilized a discharging phenomenon where charging of the image bearing member is performed using a corona charger, so that it becomes possible to realize completely ozone-less and low-power-consumption charging. As a result, this injection charging receives more and more attention. Also, it becomes possible to prevent the lowering of charging ability and the smeared image phenomenon. In addition, because charging is performed in the vicinity of an applied voltage, it becomes easy to perform control of a potential.

Figure 3:
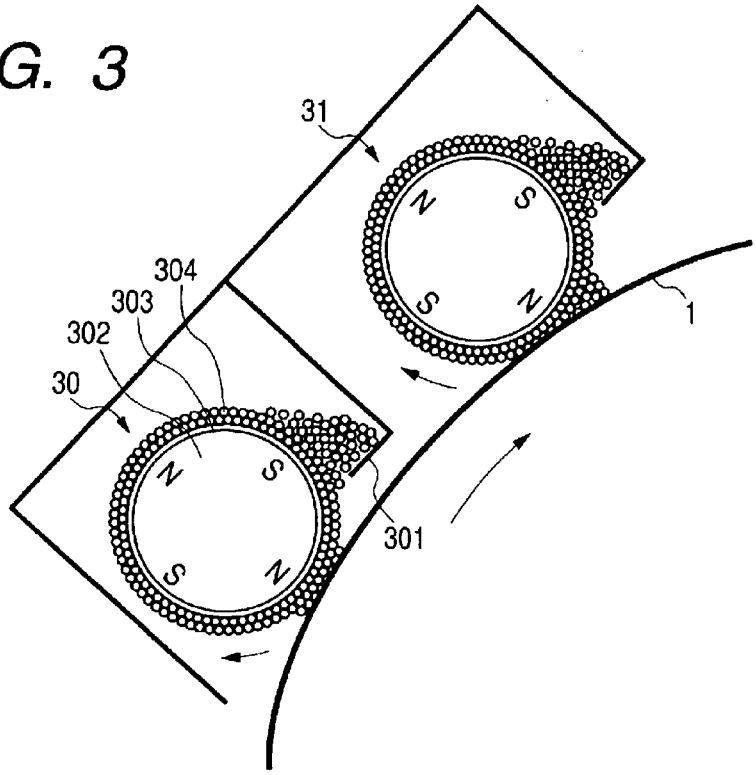
FIG. 3 is a front view showing the details of magnetic brush chargers that are injection chargers adopting a magnetic brush system.

In FIG. 3, as injection chargers adopting a magnetic brush system, there are shown details of the magnetic brush charger 30 that is first (upstream side) charging means and the magnetic brush charger 31 that is second (downstream side) charging means. The fundamental constructions of the magnetic brush chargers 30 and 31 are substantially the same to each other, so that the magnetic brush charger 30 will be described as a representative in this embodiment. With the injection charger adopting the magnetic brush system, conductive magnetic particles are magnetically constrained directly on magnetic field generating means (magnet) or on a magnetic particle holding member (conductive sleeve) that contains magnetic field generating means (magnet). Then, the magnetic particles are brought into contact with the image bearing member while performing stoppage or rotation and there is performed application of a voltage. As a result, charging is started.

The magnetic brush charger 30 is constructed by a fixed magnet 302, a non-magnetic charging sleeve (sleeve made of a metal such as aluminum) 303 that rotates outside of the fixed magnet 302, and magnetic particle regulating means 301 for regulating the adhesion amount of the charging magnetic particles 304 adhering onto the surface of this charging sleeve 303.

The charging magnetic particles 304 regulated by the magnetic particle regulating means 301 are made to have a brush shape by a magnetic field on the non-magnetic charging sleeve 303 that is capable of freely rotating, and are conveyed onto the photosensitive drum 1 functioning as a body to be charged in accordance with rotation of the charging sleeve 303. Also, the magnetic brush rotates in a counter direction in a contact portion in which the magnetic brush contacts the photosensitive drum 1, and the charging sleeve 303 rotates in the counter direction with respect to the photosensitive drum 1. Also, the rotation speed of the photosensitive drum 1 is set at 300 mm/sec and the magnetic brush charger 30 rotates at a speed of 360 mm/sec. By applying a charging voltage to the charging sleeve 303, charges are given onto the photosensitive drum 1 from the charging magnetic particles 304 through the magnetic brush contact portion, and the photosensitive drum 1 is charged to a potential having a value close to the charging voltage.

In the magnetic brush chargers 30 and 31, a contact nip width of the charging magnetic particles 304 formed on the photosensitive drum 1 in the rotation direction of the photosensitive drum 1 is adjusted so as to become 4 mm. Also, as the charging magnetic particles 304, there are used magnetic particles whose average particle diameter is in a range of from 10 to 100 μm, saturation magnetization is in a range of from 20 to 250 emu/cm$^3$, and volume resistivity is in a range of from $10^2$ to $10^{10}$ Ω·cm. In particular, when consideration is given to a possibility that a defect concerning insulation, such as a pinhole, exists on the photosensitive drum 1, it is preferable that there are used magnetic particles having a volume resistivity of at least $10^6$ Ω·cm. In order to improve charging performance, it is preferable that the resistance of the charging magnetic particles 304 is reduced as much as possible. Therefore, in this embodiment, there are used magnetic particles whose average particle diameter is 25 μm, saturation magnetization is 200 emu/cm$^3$, and resistance is $5\times10^6$ Ω·cm. Also, the charging magnetic particles 304 used in this embodiment are obtained by oxidizing a ferrite surface and performing reduction processing and resistance adjustment. Here, the resistance value of the charging magnetic particles is measured by putting 2 g of charging magnetic particles into a metallic cell, whose base area is 228 mm$^2$, weighing them at 6.6 Kg/cm$^2$, and applying a voltage of 100 V.

Figure 4:
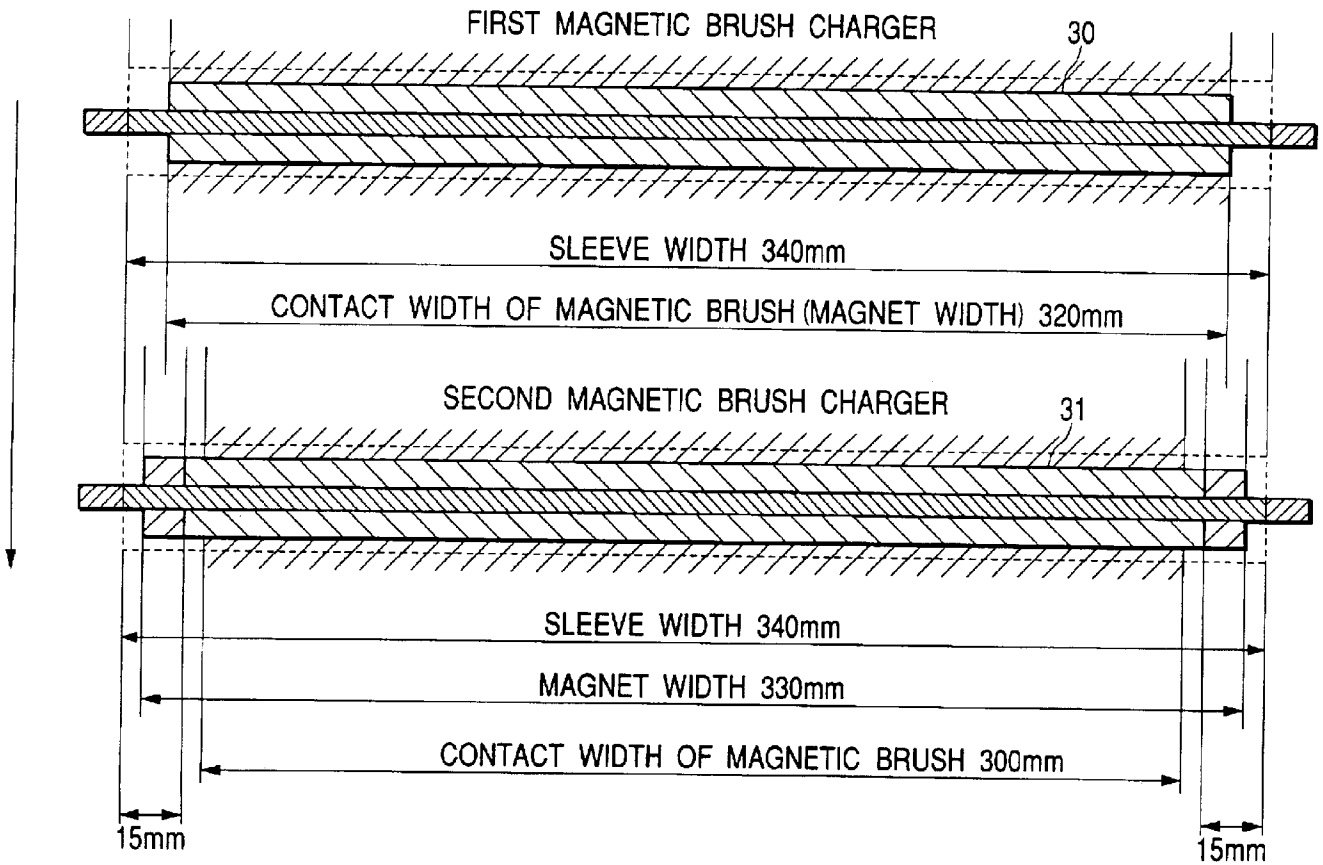
FIG. 4 is an explanatory diagram showing an example of a size of each portion of first magnetic brush charger and second magnetic brush charger in accordance with the first embodiment of the present invention.

In this embodiment, in the rotation direction of the photosensitive drum 1, as to the first magnetic brush charger 30 positioned on the upstream side and the second magnetic brush charger 31 positioned on the downstream side, charging sleeve widths, coating widths of the magnetic particles (contact widths of the magnetic brushes onto the photosensitive drum 1), an effective width of the magnet, and insulation processing (application of an insulation resin or the like) widths on the charging sleeve surface are set so that there is satisfied a relation shown in FIG. 4 in the longitudinal direction of the photosensitive member. To elaborate, as to the first magnetic brush charger 30, the charging sleeve width is set at 340 mm, the magnetic particle coating width is set at 320 mm, the magnet effective width is set at 320 mm, and no insulation processing is performed. Also, as to the second magnetic brush charger 31, the charging sleeve width is set at 340 mm, the magnetic particle coating width (contact width of the magnetic brush onto the photosensitive drum 1) is set at 300 mm, the magnet effective width is set at 330 mm, and the insulation processing is performed on the surface in end portions of the charging sleeve 303 so that each portion of the sleeve having a width of 15 mm from one of end portions thereof is processed.

Also, as to the bias voltage, a direct current voltage of 550 V is applied to the charging sleeve of the first magnetic brush charger 30 and a direct current voltage of 500 V is applied to the charging sleeve of the second magnetic brush charger 31. A charging process is performed by applying the voltage, so that the photosensitive drum 1 is charged to around 550 V by the first magnetic brush charger 30. Then, in the case of the a-Si photosensitive member, potential decay due to dark decay occurs and the charging degree is attenuated to less than 500 V immediately before charging by the second magnetic brush charger 31 is performed. The photosensitive drum 1 is charged to less than 500 V by the first magnetic brush charger 30, so that if charging is successively performed by the second magnetic brush charger 31, it becomes possible to maintain a sufficient charging time for realizing convergence to the application voltage in a charging nip. As a result, it becomes possible to obtain a uniformly charged state where there occurs no potential unevenness. Also, dark decay occurs after the photosensitive drum 1 is charged by the first magnetic brush charger 30, so that it becomes possible to substantially reduce the light carriers and to substantially suppress dark decay after the charging performed for the second time. As a result, it becomes possible to substantially improve potential unevenness and the like due to potential unevenness or charging failure resulting from a difference in dark decay.

Further, in the magnetic brush chargers 30 and 31, the charging sleeve widths, the coating widths of the magnetic particles, the effective widths of the magnet, and the widths of the charging sleeve surfaces subjected to the insulation processing are set in the manner described above. As a result, it becomes possible to substantially suppress adhesion of the magnetic particles onto the photosensitive drum 1 in the end portions of the magnetic brush.

As a factor of the adhesion of the magnetic particles in the end portions of the magnetic brush contact portion, it is possible to cite a phenomenon where a portion that is capable of contacting the magnetic particles and is charged and a portion that is not capable of contacting the magnetic particles and is not charged coexist in the end portions of the photosensitive member and therefore a large potential difference partially occurs. In contrast to this, it is possible to use a method with which the end portions of coating of the magnetic particles are subjected to insulation processing, thereby reducing a potential gradient in the coating end portions and suppressing the magnetic particle adhesion phenomenon. In this case, however, the coating of the magnetic particles is partially subjected to the insulation processing, so that there may occur, for instance, a problem concerning the durability of the portions subjected to the insulation processing due to a detrimental effect of a difference in coating amount resulting from a difference in surface property between the magnetic particle holding member and the portions subjected to the insulation processing or due to rubbing with the magnetic particles. In addition, although it is also possible to suppress the magnetic particle adhesion phenomenon, it is difficult to completely avoid this phenomenon.

In contrast to this, by setting the magnetic brush contact width of the first magnetic brush charger 30 wider than the magnetic brush contact width of the second magnetic brush charger 31 like in this embodiment, the end portions of the magnetic brush contact portion of the second magnetic brush charger 31 are partially charged in advance, so that a potential difference between the surface of the photosensitive drum 1 and the charging sleeve is mostly eliminated. As a result, it becomes possible to prevent the adhesion of the magnetic particles in the end portions of the second magnetic brush contact portion. In other words, by setting the effective charging width of the first charger wider than the magnetic brush contact width of the second charger in the longitudinal direction of the photosensitive member, it becomes possible to prevent the adhesion of the magnetic particles onto the photosensitive member in the end portions of the magnetic brush contact portion of the second charger.

Also, the magnet effective width of the second magnetic brush charger 31 is set wider than the magnetic brush contact width of the first magnetic brush charger 30, so that it becomes possible to recover the magnetic particles adhering onto the photosensitive drum 1 in the end portions of the magnetic brush contact portion of the first magnetic brush charger 30 by means of the magnetic adsorbing power of the magnet of the second magnetic brush charger 31. At this time, by performing insulation processing on portions (end portion areas), which recover the magnetic particles from the drum, of the surface of the charging sleeve of the second magnetic brush charger 31, it becomes possible to enhance the recovering property. In usual cases, the portions subjected to the insulation processing are portions that are not coated with the magnetic particles, as described above. Therefore, even if there is a difference in surface property with the non-magnetic sleeve, there occurs no particular detrimental effect. It is sufficient that the diameter and magnetic flux density of the magnet of the second magnetic brush charger, a distance from the sleeve of the second magnetic brush charger to the photosensitive drum 1, and the like are set as appropriate so that it is possible to absorb the magnetic particles from the photosensitive member end portion areas onto the sleeve by means of the magnetic force of the magnet of the second magnetic brush charger.

As has been described above, by setting the magnetic brush contact width of the first magnetic brush charger 30 wider than the magnetic brush contact width of the second magnetic brush charger 31 and by charging portions of the photosensitive member corresponding to the end portions of the magnetic brush contact portion of the second magnetic brush charger 31 in advance, it becomes possible to prevent the adhesion of the magnetic particles in the end portions of the magnetic brush contact portion of the second magnetic brush charger. Also, the magnet effective width of the second magnetic brush charger 31 is set wider than the magnetic brush contact width of the first magnetic brush charger 30, so that it becomes possible to recover the magnetic particles, which adhere to portions of the photosensitive drum 1 corresponding to the end portions of the magnetic brush contact portion of the first magnetic brush charger 30, with the second magnetic brush charger 31.

Second Embodiment

Figure 5:
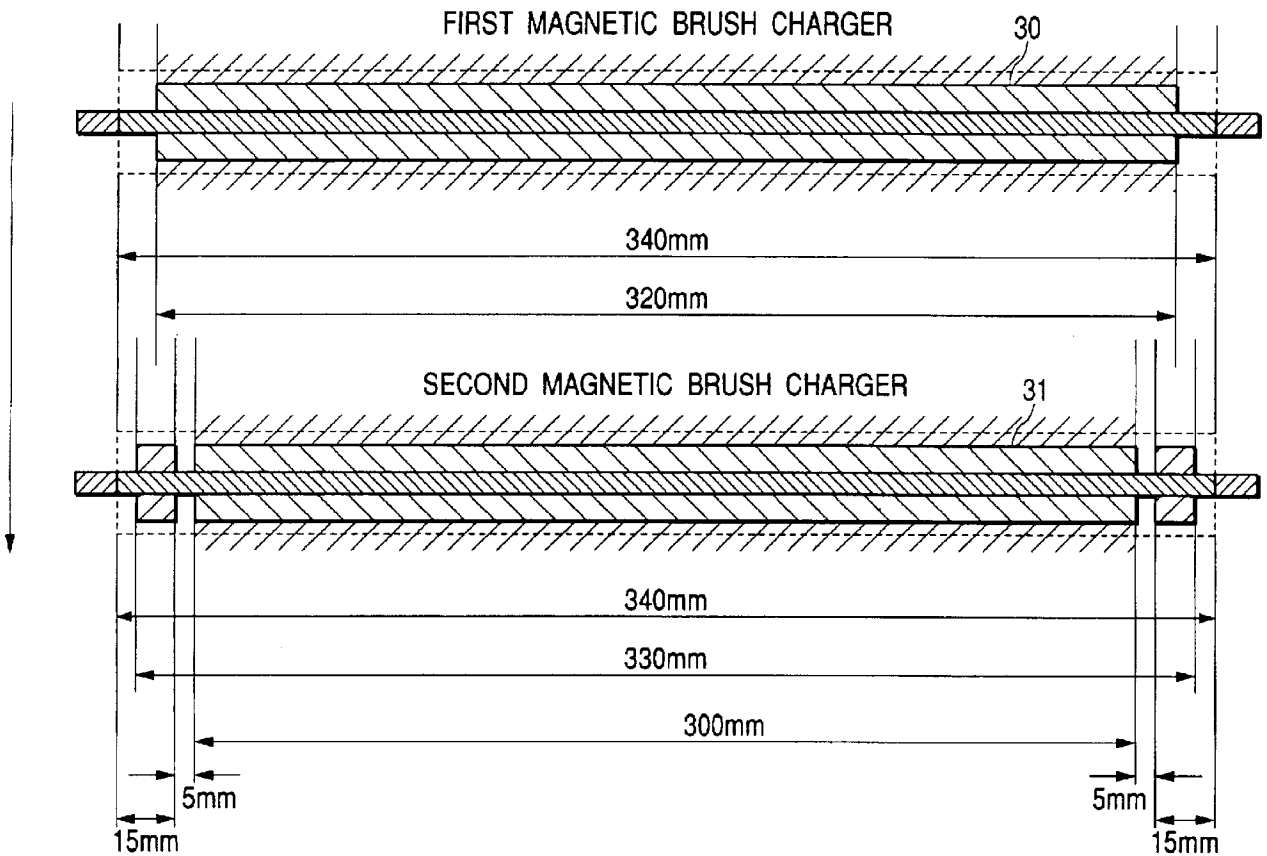
FIG. 5 is an explanatory diagram showing an example of a size of each portion of first magnetic brush charger and second magnetic brush charger in accordance with a second embodiment of the present invention.

In the first embodiment, as shown in FIG. 4, there is obtained a construction where the magnet effective width of the charging sleeve of the second magnetic brush charger 31 is set wider than the magnetic particle coating width of the first magnetic brush charger 30 and the magnetic particles adhering in end portions of the first magnetic brush charger 30 is recovered by the second magnetic brush charger 31. In contrast to this, in this embodiment, as shown in FIG. 5, as to the magnet in the charging sleeve of the second magnetic brush charger 31, the position of each external end portion of the magnet is set as the same position as that in the first embodiment and is set outside of the magnetic brush contact portion of the first magnetic brush charger 30, although portions (cut regions), in which the magnet is cut away, are provided so as to have a width of 5 mm from the end portions of the magnetic brush contact portion of the second magnetic brush charger 31. With this construction, it becomes possible to prevent the spreading of the magnetic particles to the outside in the end portions of the magnetic brush contact portion of the second magnetic brush charger 31.

In the case where the end portions of the magnet differ from the end portions of the magnetic brush contact portion (magnetic particle coating portion) of the second magnetic brush charger like in the first embodiment, the magnetic particles packed in an area of the photosensitive drum 1 that is closest to the charging sleeve tends to spread in an end portion direction. Also in the first embodiment, portions of the photosensitive member corresponding to the end portions of the contact portion of the second magnetic brush charger are charged by the first magnetic brush charger 30 in advance, so that the potential difference becomes small and there hardly occurs the adhesion of the magnetic particles to the photosensitive drum 1 by means of the magnetic field even if the magnetic particles spread. If the magnetic particles of the second magnetic brush charger spread toward the end portions of the photosensitive drum 1, however, there are generated some of the magnetic particles mechanically conveyed in the rotation direction of the photosensitive drum 1, although the number of such magnetic particles is very small. In contrast to this, if the cut regions of the magnet are provided in end portions of the magnetic brush contact portion of the second magnetic brush charger 31 like in this embodiment and are set so that there is prevented the spreading of the end portions of the magnetic brush contact portion to the outside, it also becomes possible to prevent the mechanical adhesion to the drum. As a result, it becomes possible to further enhance the effect of preventing leakage of the magnetic particles.

Also, the magnet cut regions of the second magnetic brush charger 31 are respectively set so as to have a width of 5 mm from the magnetic brush contact portion end portions (magnetic particle coating area end portions) toward the outside. In addition, two end portion magnets are respectively provided so as to have a width of 10 mm from positions that are respectively separated by 5 mm from the magnetic brush contact portion end portions. That is, each end portion magnet is provided in an area that extends inwardly by 5 mm and outwardly by 5 mm with respect to one of the end portions of the magnetic brush contact portion of the first magnetic brush charger 30. With this construction, the magnet effective width of the second magnetic brush charger 31 is set at 330 mm that is substantially the same as in the first embodiment. Therefore, like in the first embodiment, it is possible to recover the magnetic particles adhering to the drum in the end portions of the first magnetic brush charger 30 by means of the magnetic absorption force of the magnet of the second magnetic brush charger 31.

Third Embodiment

Figure 6:
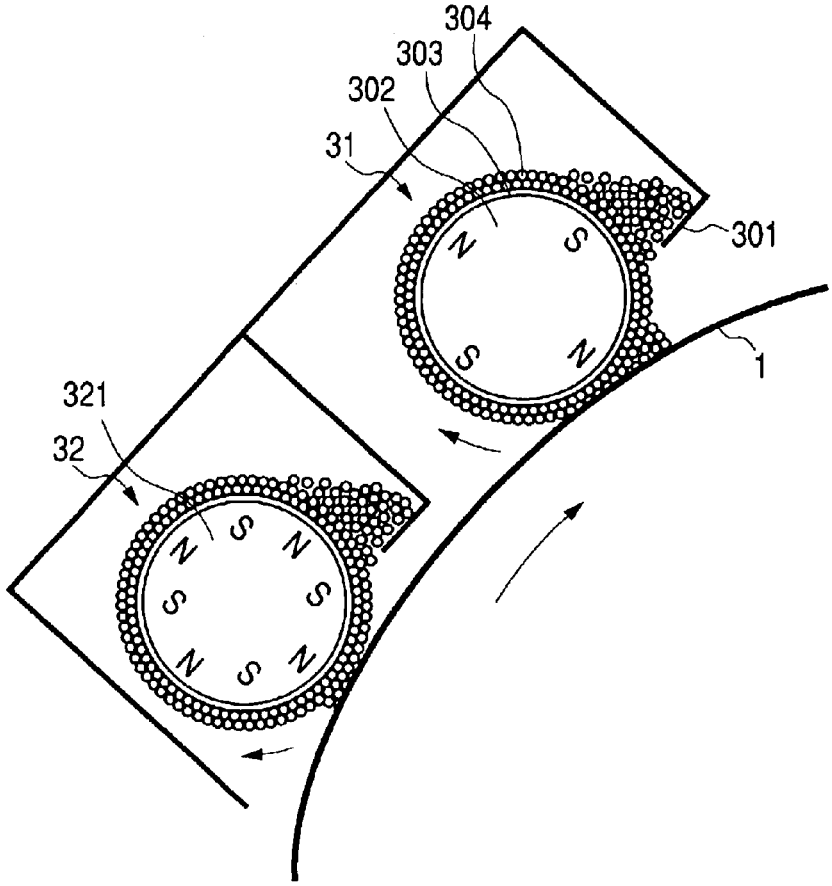
FIG. 6 is a front view showing a construction of magnetic brush chargers in accordance with a third embodiment of the present invention.
Figure 7:
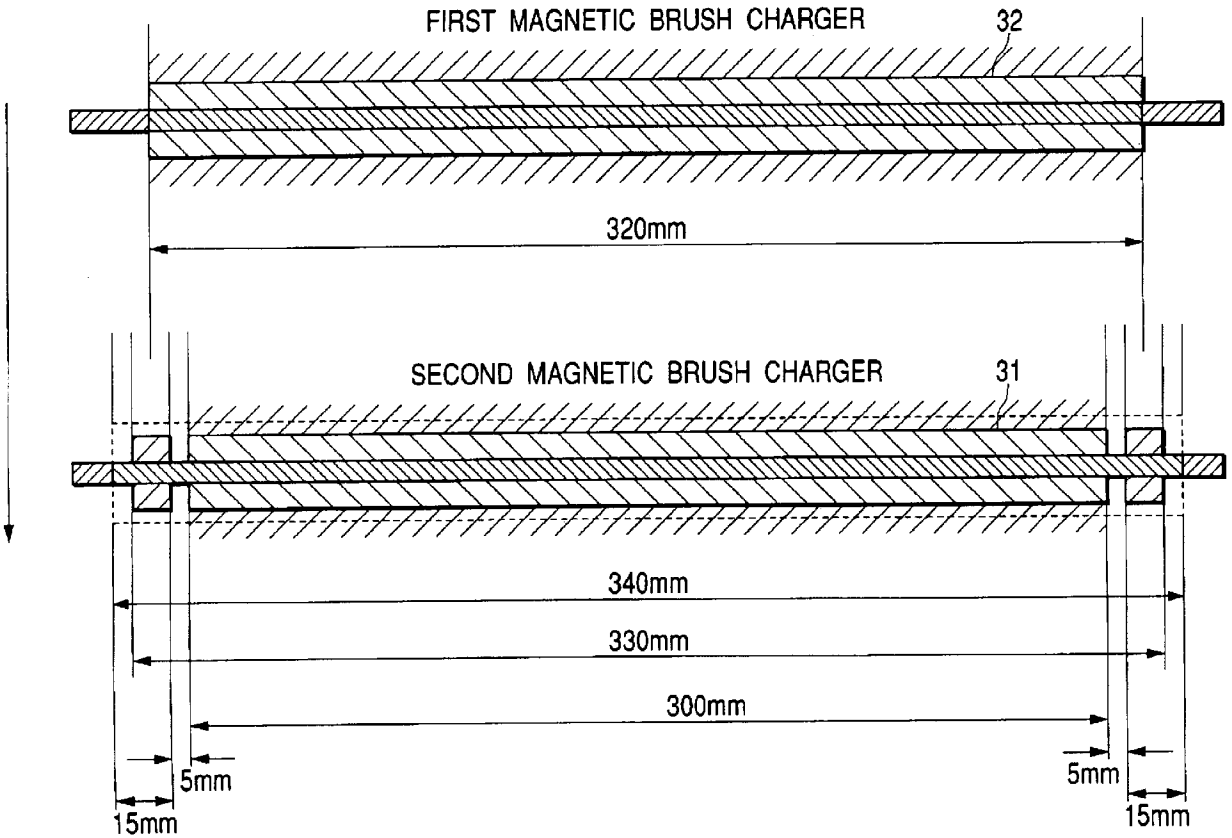
FIG. 7 is an explanatory diagram showing an example of a size of each portion of first magnetic brush charger and second magnetic brush charger in accordance with the third embodiment of the present invention.

FIG. 6 shows the constructions of magnetic brush chargers in a third embodiment of the present invention. Also, FIG. 7 shows an example of the size of each portion of the first magnetic brush charger and the second magnetic brush charger in the third embodiment. In each embodiment described above, as shown in FIG. 3, there has been used a construction where as the first magnetic brush charger 30 and the second magnetic brush charger 31, the fixed magnet 302 is provided inside of the charging sleeve 303 and the magnetic particles held on the non-magnetic sleeve that is rotationally driven is brought into contact with the photosensitive drum 1, thereby performing charging.

In contrast to this, in the third embodiment, as shown in FIG. 6, as to the first charger, a magnetic brush charger 32 is used in place of the magnetic brush charger 30. Also, a magnetic brush charger adopting the sleeve driving system shown in FIG. 3 is used as the second magnetic brush charger 31. That is, the first magnetic brush charger 32 has a construction where the magnetic particles are directly held on a magnet roller 321 and conductive processing is performed on the surface of the magnet roller 321. With this construction, charging is performed by applying a voltage to the magnet itself.

Next, the first magnetic brush charger 32 used in this embodiment will be described in more detail. The magnetic brush charger 32 used in this embodiment has a construction where the surface of the magnet roller 321 is subjected to conduction processing and is directly coated with the magnetic particles. As the magnetic particles, it is possible to use magnetic particles that are the same as those used in each embodiment described above. Also, as the magnet roller 321, there is used a magnet roller that is provided with eight poles at regular intervals and has the maximum magnetic force of around 1000 G. In the case where the magnet roller 321 is made to directly hold the magnetic particles and is rotationally driven like in this embodiment, it is preferable that the poles are arranged at regular intervals. Also, as to the number of poles, it is advantageous that the pitches between the poles are reduced because contact unevenness due to the magnetic brush state of the magnetic particles with respect to the circumferential direction of the magnetic particles is suppressed by increasing the number of poles. Therefore, it is preferable that the number of poles is increased as much as possible. If the number of poles is set so as to exceed a given number, however, there tends to occur a reduction in magnetic force. Therefore, it is preferable that the number of poles is set in a range of from 4 to 16.

In this embodiment, charging performed for the first time is carried out using the magnet roller 321 that has eight poles as has been described above. At this time, in the case where the charging is performed only with the first magnetic brush charger 32, a contact state varies to some extent between each pole portion and each inter-pole portion, so that there is observed slight charging unevenness. By using the second magnetic brush charger 31 like in this embodiment, however, the potential unevenness is uniformized, so that even if the magnetic brush charger having the charger construction in this embodiment is used as the second magnetic brush charger 31, it is possible to obtain a satisfactory output image.

As has been described above, charging is performed using the first magnetic brush charger 32 where the magnetic particles are directly held by the magnet roller 321, and the charging performed for the second time is carried out using the second magnetic brush charger 31 where the magnetic particles are conveyed using the non-magnetic sleeve 303 that is capable of being rotationally driven with respect to the fixed magnet roller 302 like in each embodiment described above. With this construction, the relation between the magnetic brush contact widths (magnetic particle coating widths) in the longitudinal direction and the magnet effective width of the case where the charging process is performed are set in the same manner as in each embodiment described above. To elaborate, the magnetic brush contact width (magnetic particle coating width) of the first magnetic brush charger 32 is set at 320 mm and the lengthwise width of the magnet roller 302 is also set at 320 mm. As to the conditions of the second magnetic brush charger 31, like in each embodiment described above, the magnetic brush contact width (magnetic particle coating width) is set at 300 mm and the effective width of the magnet is set at 330 mm. More preferably, like in the second embodiment shown in FIG. 5, by cutting the magnet so that each cut region has a width of several mm (5 mm, in this embodiment) from one of end portions of the magnetic brush contact portion toward the outside, it becomes possible to prevent the spreading of the magnetic particles toward the outside of the coating. Also, in portions of the photosensitive drum corresponding to the end portions of the magnetic brush contact portion of the first magnetic brush charger, end portion magnets are provided for the second magnetic brush charger. As shown in FIG. 7, each end portion magnet is provided so as to extend inwardly by 5 mm and outwardly by 5 mm with respect to the position of one of the end portions of the contact portion of the first magnetic brush.

As has been described above, even if there is used the method with which the magnetic particles are directly held by the magnet roller without providing the magnetic brush charger with a charging sleeve, the magnetic brush contact width of the first magnetic brush charger 32 is set wider than the magnetic brush contact width of the second magnetic brush charger 31 and portions of the photosensitive member corresponding to the end portions of the magnetic brush contact portion of the second magnetic brush charger 31 are charged in advance. As a result, it becomes possible to prevent adhesion of the magnetic particles in the end portions of the second magnetic brush contact portion. Also, like in each embodiment described above, the magnet effective width of the second magnetic brush charger 31 is set wider than the magnetic brush contact width of the first magnetic brush charger 32, so that it becomes possible to recover the magnetic particles adhering to the photosensitive member in the first magnetic brush charger 32 with the second magnetic brush charger 32. That is, in portions of the photosensitive member corresponding to end portions of the magnetic brush contact portion of the first magnetic brush charger, there are provided the end portion magnets of the second magnetic brush charger, so that it becomes possible to recover the magnetic particles on the photosensitive member leaving from the first magnetic brush charger by means of a magnetic action of the end portion magnets.

Also, in the first to third embodiments, there is used a method with which the magnetic particles are conveyed and charging is performed using the non-magnetic sleeve that is capable of being rotationally driven with respect to the fixed magnet roller in the second magnetic brush charger 31. However, it is possible to perform the charging even if the second magnetic brush charger 31 uses a system where the magnetic particles are directly held by the magnet roller.

In the first to third embodiments described above, there has been described a construction where the magnetic particles adhering to the photosensitive member in the first magnetic brush charger are recovered by the second magnetic brush charger. In the case where the amount of such adhering magnetic particles becomes large, however, there occurs a state where the amount of the magnetic particles remaining in the first magnetic brush charger becomes small and the amount of the magnetic particles existing in the second magnetic brush charger becomes large. In such a case, it is preferable that there is used a construction where the magnetic particles recovered by the second magnetic brush charger 31 or 32 are returned to the first magnetic brush charger 30 or a construction where the first magnetic brush charger and the second magnetic brush charger are integrally constructed to form a container and the magnetic particles are circulated in this container. In the case where the first magnetic brush charger and the second magnetic brush charger are integrally constructed as a container, there may be used a construction where respective sleeves are coated with the magnetic particles independently of each other or a construction where the magnetic particles are passed and conveyed between a plurality of sleeves in a belt manner. By using such a construction, it becomes possible to maintain a state where the magnetic particles are contained in the first magnetic brush charger and the second magnetic brush charger in proper amounts.

The present invention is not limited to the embodiments described above and it is possible to make various modifications within the scope of the technical idea of the present invention.

What is claimed is:

1. A charging apparatus comprising:

first charging means for charging a body to be charged, said first charging means including a magnetic brush that contacts said body to be charged; and second charging means that is provided on a downstream side of said first charging means with respect to a moving direction of said body to be charged, said second charging moans including a magnetic brush that contacts said body to be charged, wherein said second charging means includes magnetic field generating means that is provided so as to extend outwardly in a longitudinal direction of said body to be charged beyond at least end portions of contact of said magnetic brush of said first charging means with said body to be charged.

2. A charging apparatus according to claim 1, wherein an effective width of said magnetic field generating means is wider than the contact width with which said magnetic brush of said first charging moans contacts said body to be charged.

3. A charging apparatus according to claim 1, wherein said second charging means includes a holding member that holds said magnetic brush of said second charging means, and wherein a surface of said holding means includes insulation portions at specific positions with respect to a longitudinal direction of said body to be charged, the specific positions respectively corresponding to the end portions of the contact of said magnetic brush of said first charging means with said body to be charged.

4. A charging apparatus comprising:

first charging means for charging a body to be charged, said first charging means including a magnetic brush that contacts said body to be charged; and second charging moans that is provided on a downstream side of said first charging means with respect to a moving direction of said body to be charged, said second charging means including a magnetic brush that contacts said body to be charged, wherein a contact width, with which said magnetic brush of said first charging means contacts said body to be charged, is wider than a contact width with which said magnetic brush of said second charging means contacts said body to be charged, and wherein said second charging means includes magnetic field generating means that is provided so as to extend outwardly in a longitudinal direction of said body to be charged beyond at least end portions of contact of said magnetic brush of said first charging means with said body to be charged.

5. A charging apparatus according to claim 4, wherein an effective width of said magnetic field generating means is wider than the contact width with which said magnetic brush of said first charging means contacts said body to be charged.

6. A charging apparatus according to claim 4, wherein said second charging means includes a holding member that holds said magnetic brush of said second charging means, and wherein a surface of said holding means includes insulation portions at specific positions with respect to a longitudinal direction of said body to be charged, the specific positions respectively corresponding to the end portions of the contact of said magnetic brush of said firs: charging means with said body to be charged.

7. An image forming apparatus comprising:

a body to be charged;

first charging means for charging said body to be charged, said first charging means including a magnetic brush that contacts said body to be charged;

second charging means that is provided on a downstream aid, of said first charging means with respect to a moving direction of said body to be charged, said second charging means including a magnetic brush that contacts said body to be charged, image forming means that is provided on a downstream side of said second charging means and on an upstream side of said first charging means with respect to the moving direction of said body to be charged, and forms an image on said body to be charged, wherein said second charging means includes magnetic field generating means that is provided so as to extend outwardly in a longitudinal direction of said body to be charged beyond at least end portions of contact of said magnetic brush of said first charging means with said body to be charged.

8. An image forming apparatus according to claim 7, wherein an effective width of said magnetic field generating means is wider than the contact width with which said magnetic brush of said first charging means contacts said body to be charged.

9. An image forming apparatus according to claim 7, wherein said second charging means includes a holding member that holds said magnetic brush of said second charging means, and wherein a surface of said holding means includes insulation portions at specific positions with respect to a longitudinal direction of said body to be charged, the specific positions respectively corresponding to end portions of contact of said magnetic brush of said first charging means with said body to be charged.

10. A image forming apparatus according to claim 7, wherein said body to be charged is a photosensitive member, and wherein said image forming means includes:

exposing means far exposing said photosensitive member in order to form a latent image on said photosensitive member; and developing means for developing the latent image with toner.

11. A image forming apparatus according to claim 10, wherein said photosensitive member includes amorphous silicon.

12. An image forming apparatus comprising:

a body to be charged;

first charging means for charging said body to be charged, said first charging means including a magnetic brush that contacts said body to be charged;

second charging means that is provided on a downstream side of said first charging means with respect to a moving direction of said body to be charged, said second charging means including a magnetic brush that contacts said body to be charged, wherein a contact width, with which said magnetic brush of said first charging means contacts said body to be charged, is wider than a contact width with which said magnetic brush of said second charging means contacts said body to be charged, and wherein said second charging means includes magnetic field generating means that is provided so as to extend outwardly in a longitudinal direction of said body to be charged beyond at least cud portions of contact of said magnetic brush of said first charging means with said body to be charged.

13. An image forming apparatus according to claim 12, wherein an effective width of said magnetic field generating means is wider than the contact width with which said magnetic brush of said first charging means contacts said body to be charged.

14. An image forming apparatus according to claim 12, wherein said second charging means includes a holding member that holds said magnetic brush of said second charging means, and wherein a surface of said holding means includes insulation portions at specific positions with respect to a longitudinal direction of said body to be charged, the specific positions respectively corresponding to end portions of contact of said magnetic brush of said first charging means with said body to be charged.

15. An image forming apparatus according to claim 12, wherein said body to be charged is a photosensitive member, and wherein said image fanning means includes:

exposing means for exposing said photosensitive member in order to form a latent image on said photosensitive member; and developing means for developing said latent image with toner.

16. An image forming apparatus according to claim 15, said photosensitive member includes amorphous silicon.

* * * * *

UNITED STATES PATENT AND TRADEMARK OFFICE

CERTIFICATE OF CORRECTION

PATENT NO. : 6,792,232 B2
DATED : September 14, 2004
INVENTOR(S) : Hiroyuki Suzuki et al.

It is certified that error appears in the above-identified patent and that said Letters Patent is hereby corrected as shown below:

Column 1,
Lines 41 and 44, "COD" should read -- CCD --.
Line 42, "portion)" should read -- portion). --.
Line 58, "table" should read -- table 10 --.

Column 4,
Line 30, "it" should read -- if --.

Column 7,
Line 6, "charging" should read -- charging is --.

Column 14,
Lines 23, 35 and 51, "moans" should read -- means --.

Column 15,
Line 15, "firs:" should read -- first --.
Line 23, "aid," should read -- side --.
Line 26, "charged," should read -- charged; and --.
Line 54, "A" should read -- An --.

Column 16,
Line 1, "far" should read -- for --.
Line 6, "A" should read -- An --.
Line 13, "charged;" should read -- charged; and --.
Line 27, "cud" should read -- end --.
Line 48, "fanning" should read -- forming --.
Line 55, "said" should read -- wherein said --.

Signed and Sealed this

First Day of February, 2005

JON W. DUDAS
*Director of the United States Patent and Trademark Office*